US005485521A

United States Patent [19]

Yagisawa et al.

[11] Patent Number: 5,485,521

[45] Date of Patent: Jan. 16, 1996

[54] AUDIO MIRROR SPEAKER

[75] Inventors: Toshihiro Yagisawa, Yokohama; Shoichi Ibaraki, Tokyo; Motokazu Kashida, Musashino; Kenichi Nagasawa, Kawasaki, all of Japan

[73] Assignee: Canon Kabushiki Kaisha, Tokyo, Japan

[21] Appl. No.: 286,915

[22] Filed: Aug. 8, 1994

Related U.S. Application Data

[63] Continuation of Ser. No. 55,779, May 3, 1993, abandoned, which is a continuation of Ser. No. 641,272, Jan. 15, 1991, abandoned.

[30] Foreign Application Priority Data

Jan. 23, 1990 [JP] Japan ..... 2-013264

[51] Int. Cl.[6] ..... H04R 5/00

[52] U.S. Cl. ..... 381/24; 381/88; 381/90; 381/160; 181/155

[58] Field of Search ..... 381/86, 24, 160, 381/88, 90, 188, 205; 181/155

[56] References Cited

U.S. PATENT DOCUMENTS

| | | | |
|---|---|---|---|
| 3,500,953 | 3/1970 | Lahti | 181/151 |
| 3,818,138 | 6/1974 | Sperrazza, Jr. | 381/89 |
| 4,058,675 | 11/1977 | Kobayashi et al. | 381/24 |
| 4,251,687 | 2/1981 | Deutsch | 381/24 |
| 4,256,922 | 3/1981 | Görike | 381/24 |
| 4,418,243 | 11/1983 | Fixler | 381/24 |
| 4,441,577 | 4/1984 | Kurihara | 381/86 |
| 4,701,951 | 10/1987 | Kash | 381/90 |
| 4,882,753 | 11/1989 | Shivers | 381/24 |
| 4,882,760 | 11/1989 | Yee | 381/24 |
| 5,031,220 | 7/1991 | Takagi et al. | 381/86 |

FOREIGN PATENT DOCUMENTS

| | | |
|---|---|---|
| 275195 | 7/1988 | European Pat. Off. . |
| 8511970 | 8/1985 | Germany . |
| 3710464 | 10/1987 | Germany . |
| 61-75144 | 3/1987 | Japan . |
| 289961 | 5/1928 | United Kingdom . |
| 395506 | 7/1933 | United Kingdom . |
| 719744 | 12/1954 | United Kingdom . |
| 912430 | 12/1962 | United Kingdom . |
| 1423811 | 2/1976 | United Kingdom . |
| 2195218 | 3/1988 | United Kingdom . |

*Primary Examiner*—Brent A. Swarthout
*Assistant Examiner*—Nina Tong
*Attorney, Agent, or Firm*—Fitzpatrick, Cella, Harper & Scinto

[57] ABSTRACT

In an audio mirror speaker, an uneven area is formed on a planar mirror surface and a directivity distribution is controlled by changing a relative position of a diaphragm facing the mirror surface and the mirror. The directivity distribution of such a speaker is determined by a radius of curvature of the uneven area. Since the directivity changes with various movements of the planar mirror, a freedom in setting the directivity distribution is enhanced.

21 Claims, 9 Drawing Sheets

FIG.1A
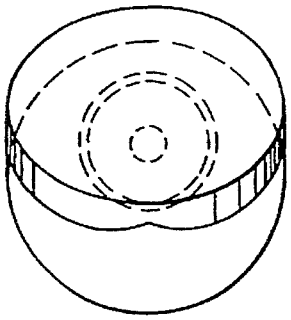
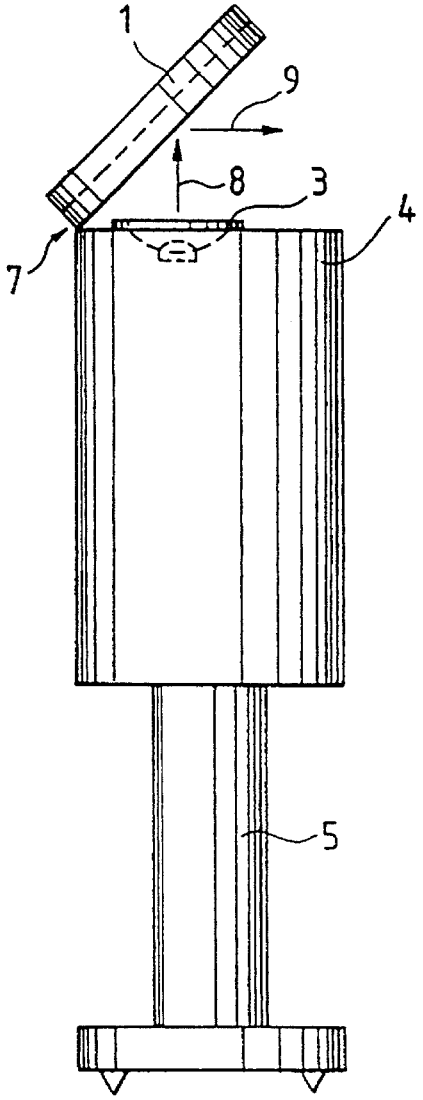
FIG.1B
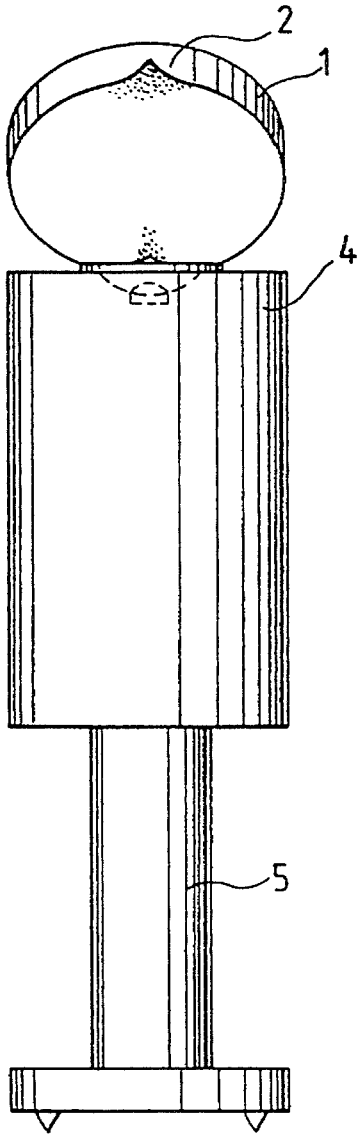
FIG.1C

FIG.3A
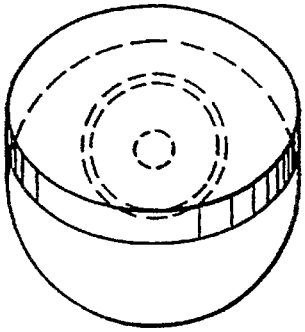
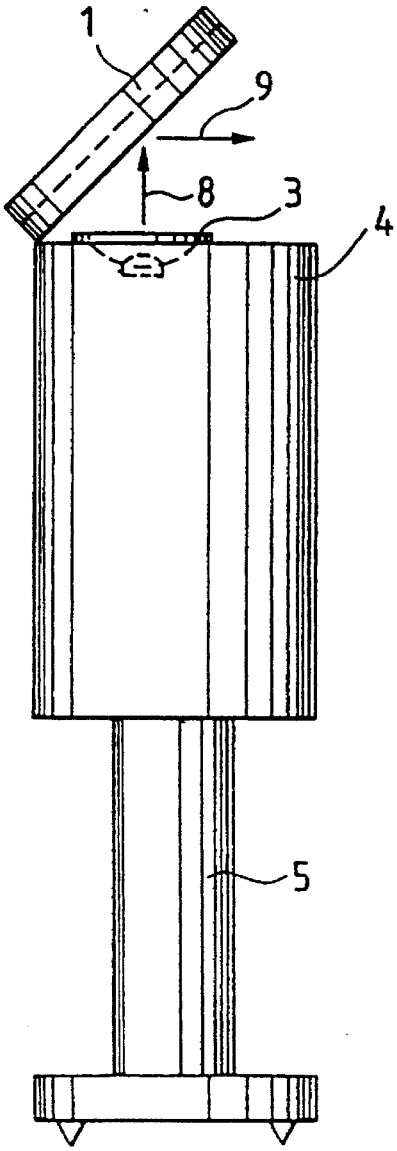
FIG.3B
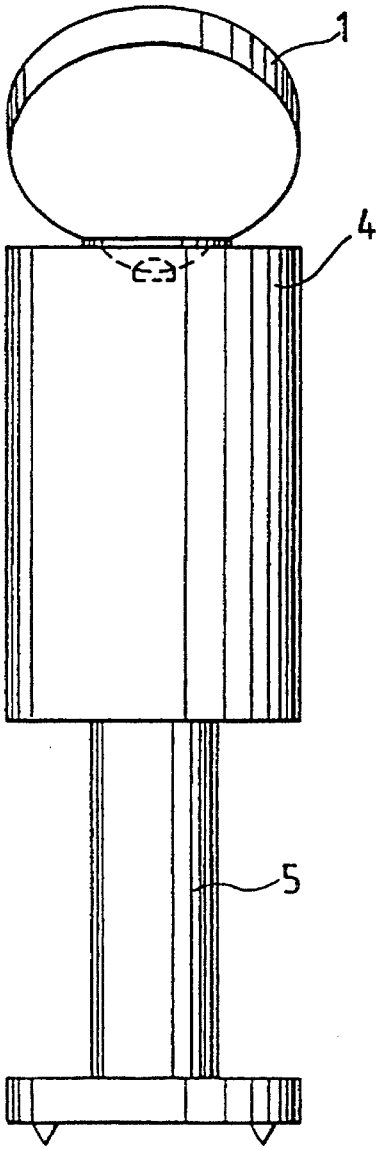
FIG.3C

FIG.6A
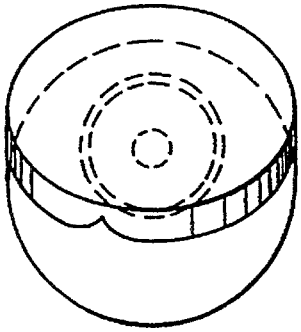
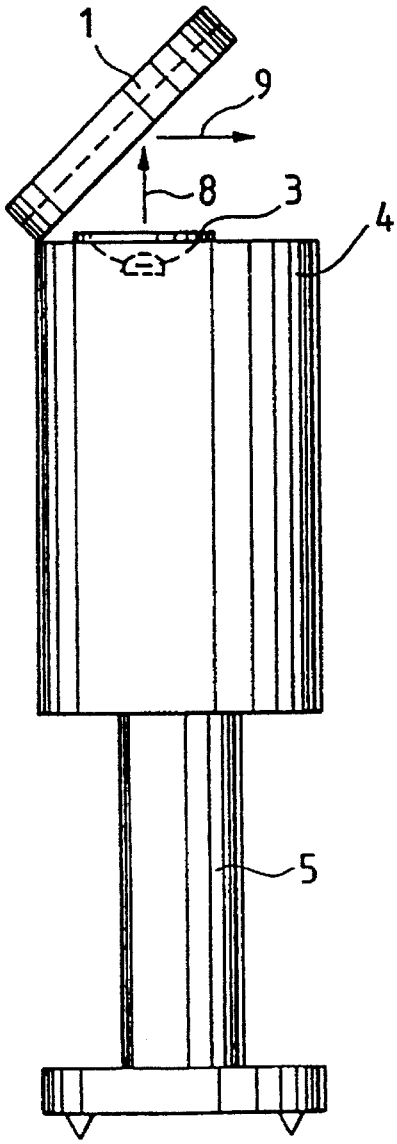
FIG.6B
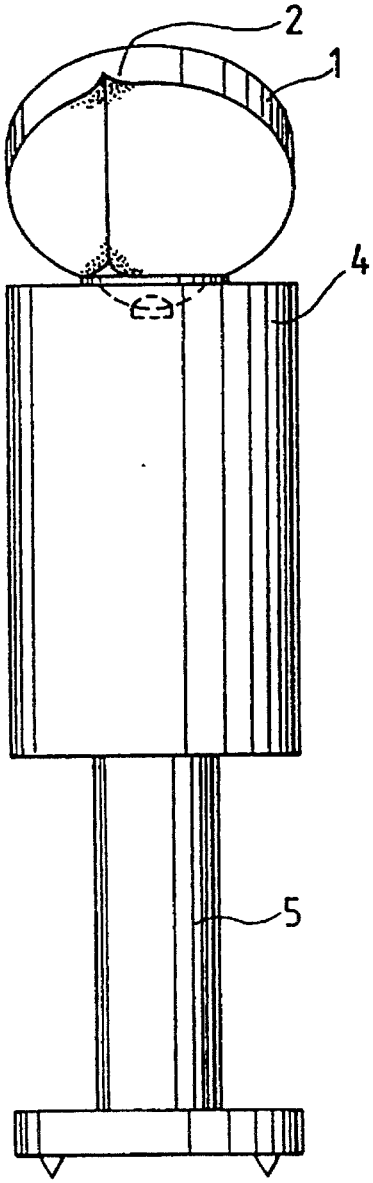
FIG.6C

FIG.9A
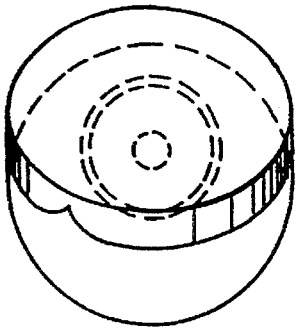
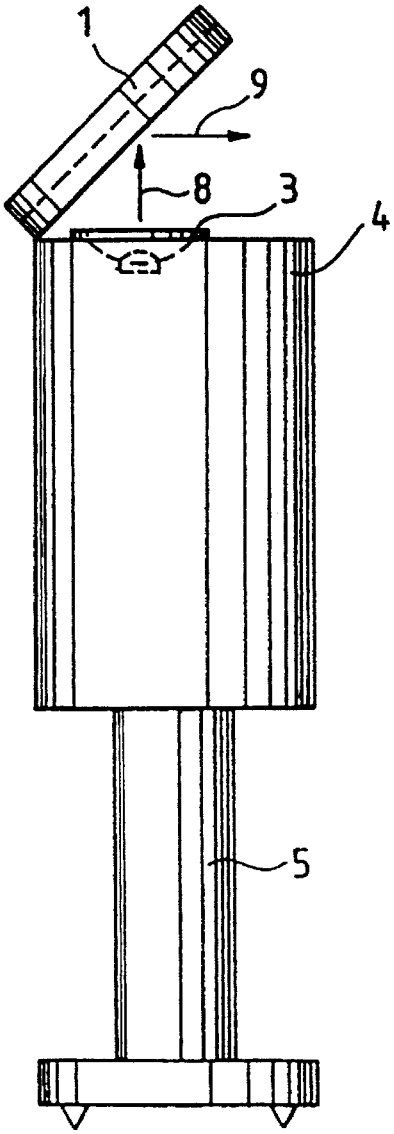
FIG.9B
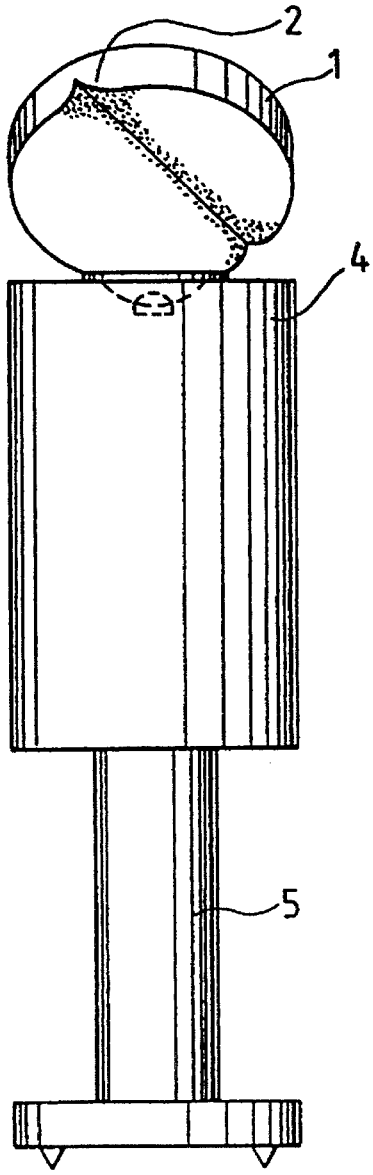
FIG.9C

FIG.11A
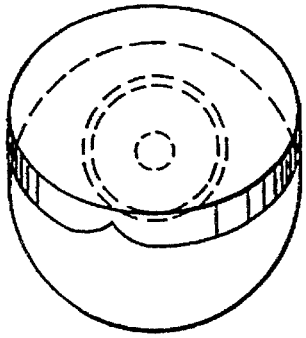
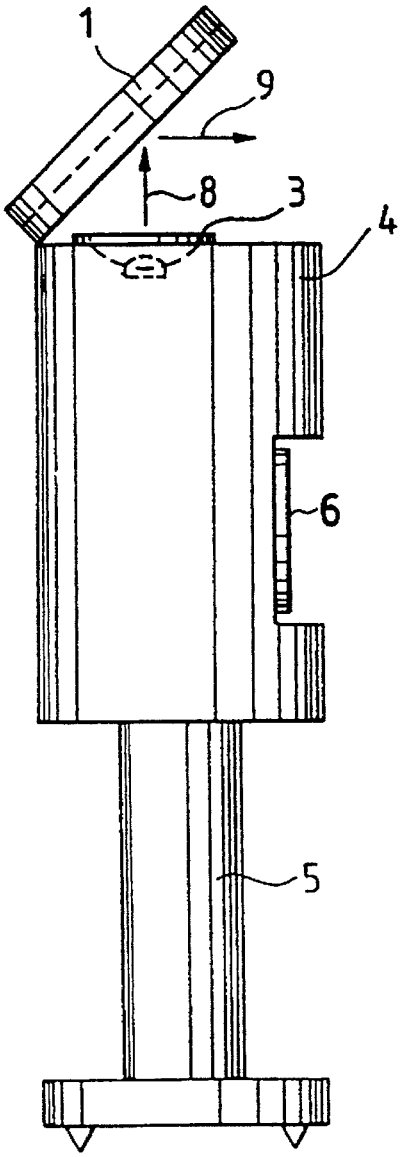
FIG.11B
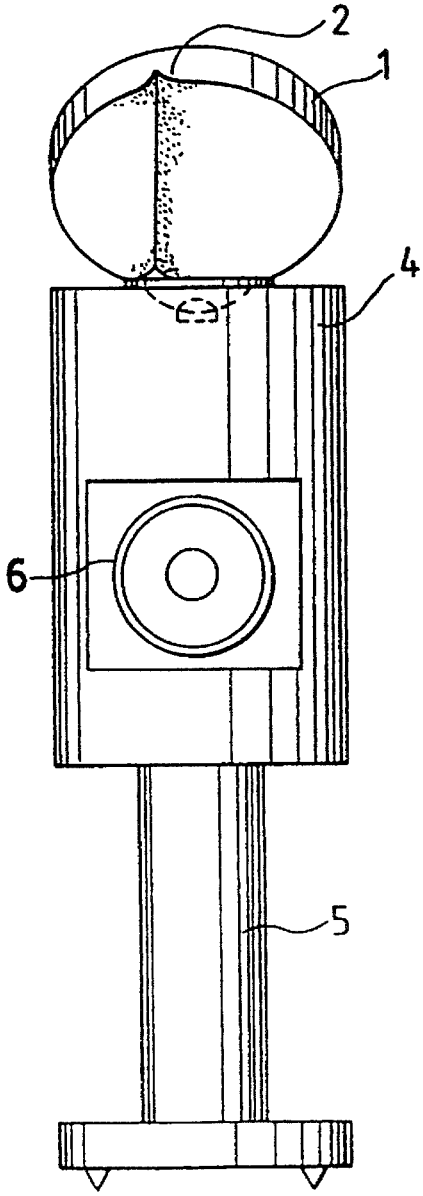
FIG.11C

AUDIO MIRROR SPEAKER

This application is a continuation, of application Ser. No. 08/055,779, filed May 3, 1993, which is a continuation of application Ser. No. 07/641,272, filed Jan. 15, 1991, now both abandoned.

BACKGROUND OF THE INVENTION

1. Field of the Invention

The present invention relates to an audio mirror speaker, and more particularly to an audio mirror speaker for reproducing a high fidelity stereo sound field.

2. Related Background Art

In an audio field, a CD (compact disk player) and a DAT (digital audio tape recorder) have been marketed and remarkable improvement of sound quality has been made. However, from a standpoint of high fidelity stereo sound, a high quality audio signal output unit in most systems has a theoretical listening point at only an apex of an isosceles triangle having a bottom side defined by two speakers. Thus, an audio system by which a listener can enjoy the high fidelity stereo sound over a wide area has not yet been spread. This is due to lack of control of a directivity distribution of an acoustic energy at the audio output unit.

The assignee oi the present invention has proposed a speaker system which enables the control of the directivity distribution over a wide area in Japanese Patent Application No. 61-75144 and U.S. Pat. application Ser. No. 07/280,936.

The audio mirror speaker disclosed in the Japanese Patent Application No. 61-75144 and the speaker system disclosed in the U.S. Pat. application Ser. No. 07/280,936 use a cone shaped rotating audio mirror as the audio mirror.

The rotating audio mirror is simple in its principle and the directivity distribution and a relation between the positions of the mirror and a diaphragm and the shapes thereof can be intuitively recognized by a designer. However, in an actual manufacturing stage of the speaker, the rotating audio mirror which determines the directivity distribution requires high precision manufacturing. As a result, the cost increases. Where the directivity is to be changed after the manufacture, a relative position of the diaphragm and the mirror is changed. The directivity can be changed only by sliding the mirror parallel to the vibration plane of the diaphragm. Accordingly, it is not usable where the directivity is to be changed as desired.

SUMMARY OF THE INVENTION

In light of the above, it is an object of the present invention to provide an audio mirror speaker which allows the control of the directivity distribution over a wide area and the setting of various directivities.

In order to achieve the above, object, in accordance with the present invention, an audio mirror speaker which has an uneven area on a planar mirror surface and in which a directivity distribution is controlled by changing a relative position of a diaphragm facing the mirror surface and the mirror, is provided.

Other objects and features of the present invention will be apparent from the detailed description of the preferred embodiments when taken in conjunction with the accompanying drawings.

BRIEF DESCRIPTION OF THE DRAWINGS

FIGS. 1A to 1C show a construction of an audio mirror speaker in accordance with a first embodiment of the present invention;

FIGS. 3A to 3C show a construction of an audio mirror speaker which uses a planar mirror;

FIGS. 6A to 6C show a construction of an audio mirror speaker in accordance with a second embodiment of the present invention;

FIGS. 9A to 9C show a construction of an audio mirror speaker in accordance with a third embodiment of the present invention;

FIGS. 11A to 11C show a construction of an audio mirror speaker in accordance with a fifth embodiment of the present invention.

DETAILED DESCRIPTION OF THE PREFERRED EMBODIMENTS

FIGS. 1A to 1C show one embodiment of the speaker of the present invention.

Figure 2A:
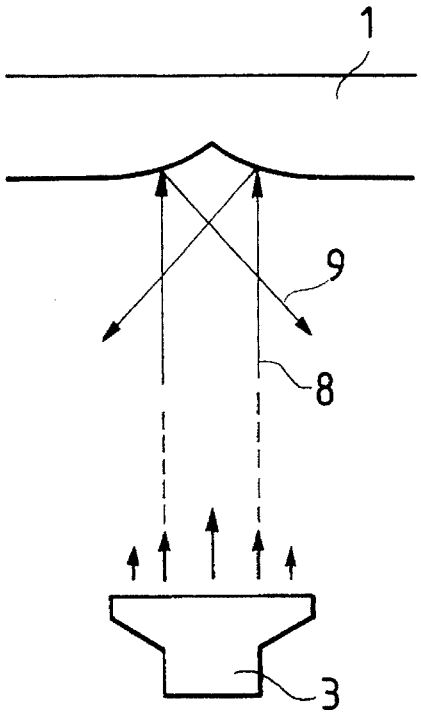
FIGS. 2A and 2B illustrate reflection and directivity of a sound wave of the speaker of FIG. 1.

Numeral 1 denotes a planar audio mirror, numeral 2 denotes a recess formed in a reflection plane of the mirror, numeral 3 denotes a diaphragm which generates sound, numeral 4 denotes a speaker cabinet, and numeral 5 denotes a leg of the speaker cabinet. Numeral 7 denotes a hinge (detail of which is not shown) for movably mounting the audio mirror 1 on the speaker cabinet 4. Thus, the inclination of the audio mirror 1 to the speaker cabinet 4 or the diaphragm 3 is adjustable. A sectional view of the audio mirror 1 of FIG. 1 is shown in FIG. 2A (in which the like elements are designated by the like numerals).

An operation is described below.

In FIG. 1B, a sound wave emitted from the diaphragm 3 is directed to the audio mirror 1 (arrow 8). The soland wave is reflected by the audio mirror 1 with directivity (arrow 9).

The reflection is explained with reference to FIGS. 2A and 2B.

Figure 4A:
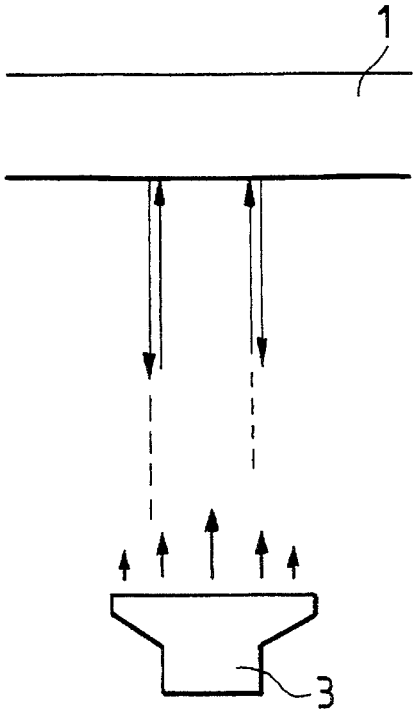
FIGS. 4A and 4B illustrate reflection and directivity of a sound wave of the speaker of FIG. 3.

In FIG. 2A, the sound wave emitted from the diaphragm 3 is reflected by the audio mirror 1. The arrow 8 indicates the direction of the sound wave directed to the mirror, and the arrow 9 indicates the direction of the sound wave reflected by the mirror. Since the mirror is of concave shape, the reflected wave is reflected in a direction other than that of the incident wave. In the recess, the mirror is of convex shape, accordingly, the sound wave is spread around the recess. FIG. 2B illustrates the spread by the mirror 1. As seen from FIG. 2B, in the speaker of FIG. 1, the sound spreads obliquely toward the front (direction of sound field) of the overall speaker system. For comparison purpose, a construction of a speaker without a recess is shown in FIGS. 3A to 3C, and a direction of propagation of the sound wave by the speaker of FIG. 3B is shown in FIGS. 4A and 4B.

The sound wave emitted from the diaphragm 3 is reflected by the audio mirror 1 without significant lateral spread.

Figure 4B:
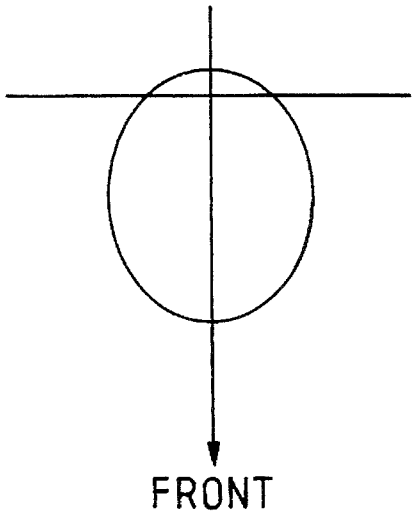
Figure 5A:
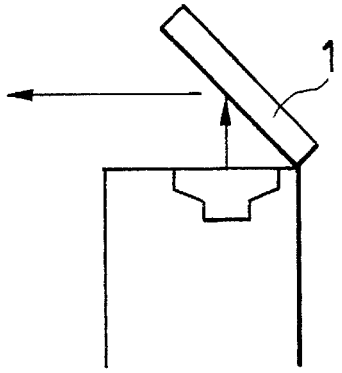
FIGS. 5A to 5D illustrate reflection of the sound wave when an inclination of the mirror is changed in the speaker of FIG. 1.
Figure 5B:
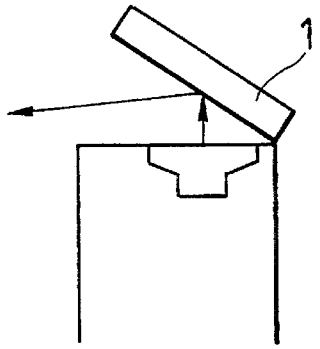
Figure 5C:
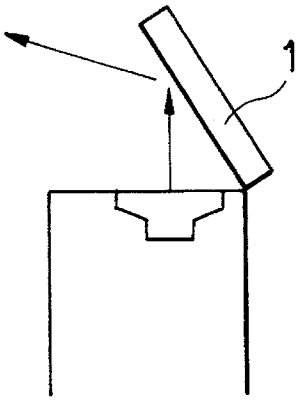
Figure 5D:
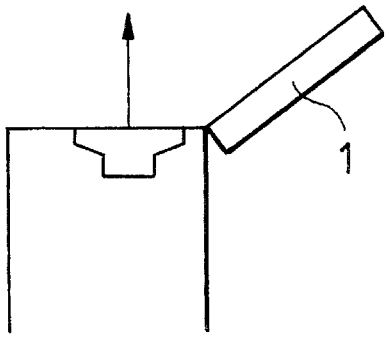

The spread is illustrated in FIG. 4B.

Figure 2B:
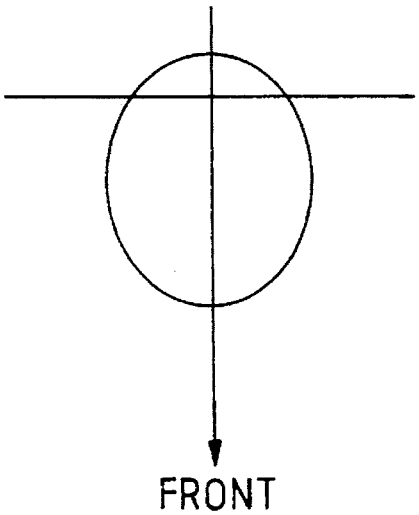

Comparing FIG. 2B and FIG. 4B, there is a trend of concentration of the sound wave to the front in FIG. 4B while an isotoropy sound pressure is obtained not only in the front but also over a wide area in FIG. 2B where the recess is provided. Accordingly, when it is used as the audio mirror speaker and the stereo speaker system disclosed in the Japanese Patent Application No. 61-75144, the same effect as that of the speaker system disclosed in the U.S. Pat. application Ser. No. 07/280,936 is attained with the simple means described above. Further, in the present invention, the vertical spread of the sound wave can be controlled by changing the inclination of the audio mirror 1 around the hinge 7 as shown in FIGS. 5A to 5D. The reflection to the front can be enhanced in FIG. 5A, the downward reflection can be enhanced in FIG. 5B and the upward reflection can be enhanced in FIG. 5C. Further, in FIG. 5D, a speaker system whose directivity is determined by a sound field spread effect is attained by opening the mirror 1.

Figure 7A:
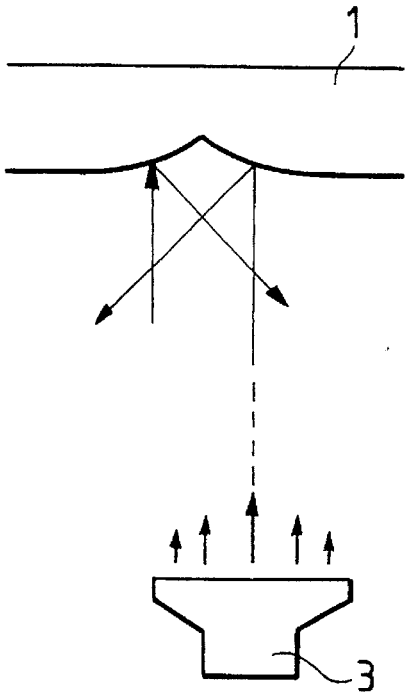
FIGS. 7A and 7B illustrate reflection and directivity of a sound wave of the speaker of FIG. 6.

FIGS. 6A to 6C show a speaker in accordance with a second embodiment of the present invention. The recess of the audio mirror 1 is provided at an off-center position of the audio mirror 1. Thus, as shown in FIG. 7A, the sound wave from the diaphragm 3 can be spread with different sound pressures on the left and right sides of the recess.

Figure 7B:
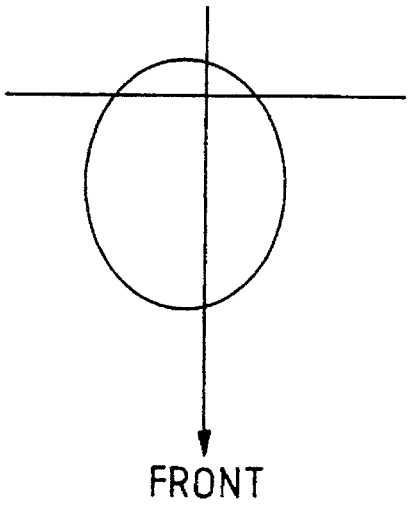

Since the sound wave at the center at which a maximum sound pressure of the diaphragm 3 is generated is reflected by a projected area on the right side of the recess, the sound level on the left side as viewed toward the speaker system can be smoothly enhanced, as shown in FIG. 7B.

Figure 8A:
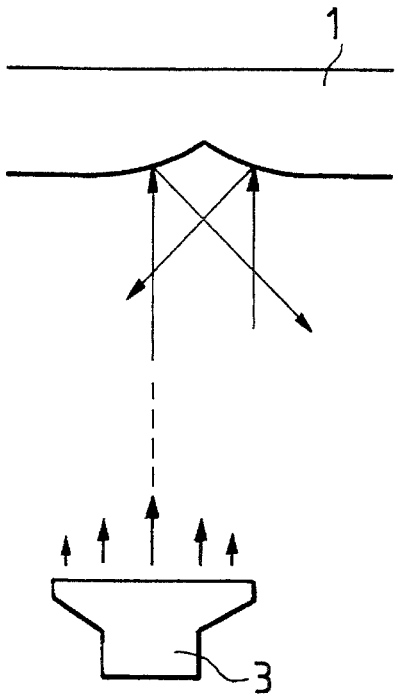
FIGS. 8A and 8B illustrate reflection and directivity of a sound wave of a speaker having a recess of the speaker of FIG. 6 shifted reversely.
Figure 8B:
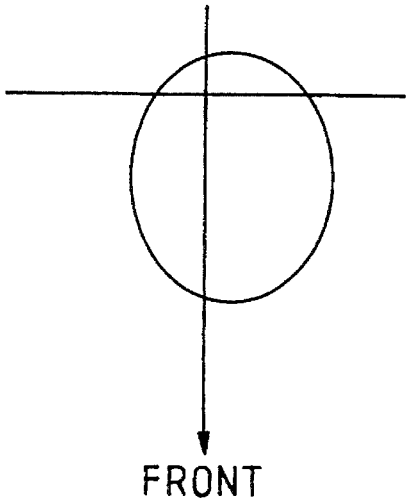

FIGS. 8A and 8B show sound wave and directivity when the recess is deviated in the opposite direction.

By arranging the speaker having the directivity shown in FIG. 7B and the speaker having the directivity shown in FIG. 8B for the right channel and the left channel of the stereo speaker system, respectively, a maximum sound pressure is generated on the listener. The directivity and effect attained when the WIS speaker system disclosed in the U.S. Pat. application Ser. No. 07/280,936 are attained without directing the speaker system inwardly as viewed toward the listener.

Where the audio mirror 1 is rendered rotatable in the mirror surface as shown in FIGS. 9A to 9C, the directivity in any direction can be attained. A slidable guide (not shown) which holds the audio mirror along an outer periphery thereof may be provided as rotating means.

Figure 10A:
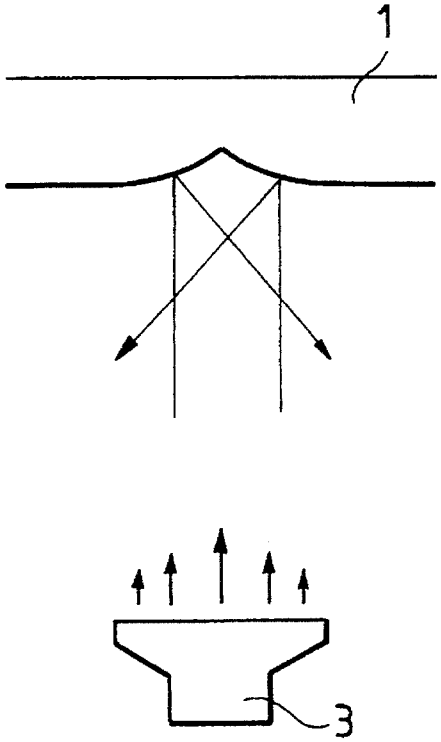
FIGS. 10A and 10B illustrate reflection and directivity of a sound wave of a speaker of a fourth embodiment of the present invention in which a width of the recess of the speaker of FIG. 1 is widened.
Figure 10B:
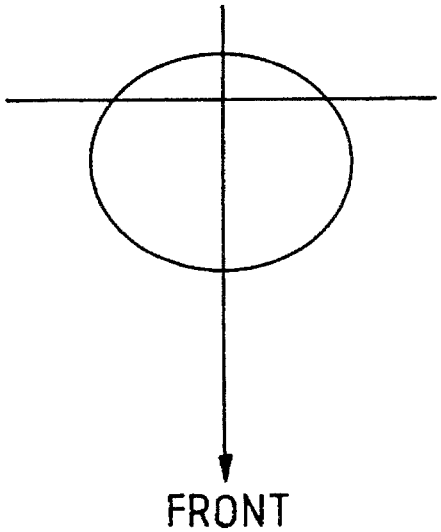

In the embodiment of FIG. 1, the contour of the recess may be rendered deeper and wider to increase the amount of spread. Where the contour of the recess is made deeper and wider as shown in FIG. 10A, the amount of reflection by that area increases and the directivity having a large lateral spread is attained as shown in FIG. 10B.

In the above embodiment, the speaker system may be constructed by a combination with conventional speakers. Since the directivity lowers in a low frequency band, a conventional speaker may be used for the low frequency band. In FIGS. 11A to 11C, a diaphragm 6 for a woofer is mounted on the front panel of the cabinet 4.

In the above embodiments, the convex recess is formed in the audio mirror to control the spread of the sound wave. The present invention is not limited to such a shape but other shape such as a convex round-shaped area may be formed. A plurality of such recesses and projected areas may be formed.

In the speakers of the above embodiments;

(1) the directivity distribution can be readily controlled by the listener, (2) the manufacture is facilitated and the cost is reduced, (3) the directivity distribution can be controlled by the size of the uneven area, the angle and the relative position of the diaphragm, (4) since most areas of the mirror are flat, the distribution toward a main direction is emphasized (compared to a cone type) up to a lower frequency band.

(5) a freedom of industrial design is increased and the use of the openable mirror such as being used in a piano is permitted. Thus, the mirror may be closed when it is not used and the deposition of dust on the driver and the damage of the driver are prevented, and (6) the present invention is applicable to not only a piston motion diaphragm but also a conventional cone or coaxial diaphragm whose effective diameter changes with frequency.

In accordance with the present invention, the audio mirror speaker whose directivity can be readily controlled after being manufactured and smoothly changes over a wide range is provided. It is particularly effective when a stereo speaker system which attains a stereo field over a wide area is desired.

We claim:

1. An audio mirror speaker, comprising:

a diaphragm mounted in a speaker cabinet; and an audio mirror having a mirror surface and mounted such that said mirror surface faces said diaphragm, said mirror surface being a flat plane and having a portion at which a recess area is formed, wherein directivity of a sound wave emitted from said diaphragm is controlled by changing a relative position between said diaphragm and said recess area.

2. An audio mirror speaker according to claim 1, wherein an angle between said mirror surface and said diaphragm is adjustable.

3. An audio mirror speaker according to claim 1, wherein said mirror surface is rotatable about an axis to change an angle between said mirror surface and said diaphragm.

4. An audio mirror speaker according to claim 1, wherein said recess area includes a portion of a cylindrical surface.

5. An audio mirror speaker according to claim 1, further comprising a cylindrical cabinet, wherein said diaphragm is mounted on an upper plane of said cylindrical cabinet.

6. An audio mirror speaker according to claim 5, wherein said audio mirror is revolvably mounted around an end of the upper plane of said cabinet.

7. An audio mirror speaker according to claim 6, wherein a support point of said audio mirror is movable along the end of the upper plane of said cabinet.

8. An audio mirror speaker according to claim 5, wherein a second diaphragm is provided on a side plane of said cylindrical cabinet.

9. An audio mirror speaker according to claim 1, wherein said recess area consists of two curved surfaces arranged adjacent to each other.

10. An audio mirror speaker according to claim 9, wherein parts of two curved surfaces oppose each other.

11. An audio mirror speaker comprising:

a speaker cabinet;

a diaphragm for protecting sound waves, said diaphragm mounted in said speaker cabinet; and an audio mirror having a mirror surface confronting said diaphragm to reflect sound waves projected from said diaphragm and to direct distribution of the sound waves, wherein a first portion of said mirror surface is flat and a second portion of said mirror surface is an uneven area for directing the sound waves projected from said diaphragm with said first portion being greater than said second portion.

12. An audio mirror speaker according to claim 11, further comprising means for adjusting an angle between said mirror surface and said diaphragm.

13. An audio mirror speaker according to claim 12, wherein said mirror surface is rotatable about an axis to change the angle between said mirror surface and said diaphragm.

14. An audio mirror speaker according to claim 11, wherein said uneven area includes a portion of a cylindrical surface.

15. An audio mirror speaker according to claim 11, wherein said speaker cabinet is cylindrical, and wherein said diaphragm is mounted on an upper plane of said cylindrical speaker cabinet.

16. An audio mirror speaker according to claim 15, further comprising mounting means for revolvably mounting said audio mirror around an end of said upper plane of said speaker cabinet.

17. An audio mirror speaker according to claim 16, wherein a support point of said audio mirror is movable along said end of said upper plane of said speaker cabinet.

18. An audio mirror speaker according to claim 15, further comprising a second diaphragm provided on a side plane of said cylindrical cabinet.

19. An audio mirror speaker according to claim 11, wherein said uneven area consists of two curved surfaces arranged adjacent to each other.

20. An audio mirror speaker according to claim 19, wherein parts of said two curved surfaces oppose each other.

21. An audio mirror speaker according to claim 11, wherein said first flat portion of said mirror reflects sound waves in a first direction and said second portion reflects sound waves in a second direction different from said first direction.

* * * * *

UNITED STATES PATENT AND TRADEMARK OFFICE

CERTIFICATE OF CORRECTION

PATENT NO. : 5,485,521

DATED : January 16, 1996

INVENTOR(S) : Yagisawa et al.

It is certified that error appears in the above-indentified patent and that said Letters Patent is hereby corrected as shown below:

COLUMN 1:

Line 3, "continuation," should read --continuation--.

COLUMN 3:

Line 12, "isotoropy" should read --isotropy--.

Signed and Sealed this

Ninth Day of July, 1996

Bruce Lehman

*Attest:*

BRUCE LEHMAN

*Attesting Officer*

*Commissioner of Patents and Trademarks*